US008858194B2

(12) United States Patent
Moreira et al.

(10) Patent No.: US 8,858,194 B2
(45) Date of Patent: Oct. 14, 2014

(54) CONSTRUCTIVE ARRANGEMENT FOR A HERMETIC REFRIGERATION COMPRESSOR

(75) Inventors: Emerson Moreira, Joinville-Sc (BR); Fabian Fagotti, Joinville-Sc (BR); Gustavo Cardoso Weber, Joinville-Sc (BR); Milton Wetzel Pereira, Joinville-Sc (BR); Ricardo Alexandre Maciel, Joinville-Sc (BR)

(73) Assignee: Whirlpool S.A., São Paulo-Sp (BR)

( * ) Notice: Subject to any disclaimer, the term of this patent is extended or adjusted under 35 U.S.C. 154(b) by 480 days.

(21) Appl. No.: 12/991,504

(22) PCT Filed: Apr. 5, 2010

(86) PCT No.: PCT/BR2010/000108

§ 371 (c)(1),
(2), (4) Date: Dec. 6, 2010

(87) PCT Pub. No.: WO2010/115253

PCT Pub. Date: Oct. 14, 2010

(65) Prior Publication Data

US 2011/0070105 A1 Mar. 24, 2011

(30) Foreign Application Priority Data

Apr. 6, 2009 (BR) ..... 0900855

(51) Int. Cl.

| | |
|---|---|
| ***F04B 39/00*** | (2006.01) |
| ***F04B 39/12*** | (2006.01) |
| ***F25B 1/02*** | (2006.01) |
| ***F04B 39/06*** | (2006.01) |

(52) U.S. Cl.

CPC ..... *F04B 39/122* (2013.01); *F04B 39/0061* (2013.01); *F25B 1/02* (2013.01); *F04B 39/066* (2013.01); *F25B 2309/061* (2013.01); *Y10S 181/403* (2013.01)

USPC ..... 417/312; 181/403

(58) Field of Classification Search

USPC ..... 417/312; 181/403

See application file for complete search history.

(56) References Cited

U.S. PATENT DOCUMENTS

| | | | |
|---|---|---|---|
| 2,505,709 | A | 4/1950 | Goldberg et al. |
| 2,583,583 | A | 1/1952 | Mangan |

(Continued)

FOREIGN PATENT DOCUMENTS

| | | | |
|---|---|---|---|
| DE | 202005015372 | U1 | 1/2006 |
| WO | WO-2005026548 | A1 | 3/2005 |

*Primary Examiner* — Peter J Bertheaud

*Assistant Examiner* — Dominick L Plakkoottam

(74) *Attorney, Agent, or Firm* — Gifford, Krass, Sprinkle Anderson & Citkowski, P.C.

(57) ABSTRACT

A hermetic compressor, comprises: a hermetic shell (1); a cylinder block (2) defining, a shell portion (Ia) and a compression cylinder (3) having an end (3*a*) opened to the exterior of the hermetic shell (1) and closed by a valve plate (5); a head (6) affixed to the cylinder block (2), over the valve plate (5) so as to define, with the latter, at least one discharge chamber (10). The cylinder block (2) incorporates a tubular projection (20) surrounding the valve plate (5) and at least part of the head (6). An outer cover (30) is hermetically affixed to the tubular projection (20) for defining therewith a discharge plenum (31) in fluid communication with the discharge chamber (10), the tubular projection (20) or the outer cover (30) being provided with a refrigerant gas outlet (40) opened to the exterior of the hermetic shell (1).

8 Claims, 3 Drawing Sheets

(56) References Cited

U.S. PATENT DOCUMENTS 5,507,627 A * 4/1996 Okazaki ..... 417/312
5,588,810 A * 12/1996 DiFlora et al. ..... 417/312
5,645,405 A * 7/1997 Ota et al. ..... 417/269
2008/0014099 A1* 1/2008 Chen Han ..... 417/312
2009/0162215 A1* 6/2009 Baba et al. ..... 417/312
2010/0310389 A1* 12/2010 Alvarenga ..... 417/312

* cited by examiner

CONSTRUCTIVE ARRANGEMENT FOR A HERMETIC REFRIGERATION COMPRESSOR

FIELD OF THE INVENTION

The present invention refers to a constructive arrangement for the discharge of gas in hermetic refrigeration compressors of the type comprising a cylinder block defining a shell portion which is hermetically closed, at one end, by a cover, said shell portion carrying the motor-compressor assembly of the compressor. The motor-compressor assembly presents a piston reciprocating in the interior of a cylinder defined in the cylinder block and which is closed, at one end, by a head, inside which is defined a discharge chamber. This compressor construction is, for example, of the type used in refrigeration systems using a refrigerant fluid usually containing carbon, such as CO2, in its composition.

BACKGROUND OF THE INVENTION

Refrigeration systems that operate with a refrigerant fluid having carbon, such as CO2 in its composition, present operational pressures higher than those obtained with other refrigerant fluids, requiring stronger compressors.

In some of said constructions, the cylinder block defines part of the compressor shell in which the motor-compressor assembly and the compression system of the compressor are mounted. The cylinder block defines, therewithin, a compression cylinder housing a piston which reciprocates, in suction and discharge strokes of the refrigerant gas from and to a refrigeration system to which the compressor is coupled. The compression cylinder is closed, at one end, by a valve plate onto which is mounted a head usually defining at least one of the discharge and suction chambers of the compressor. In the known constructions, a shell portion incorporating the cylinder block is hermetically closed by one or two outer end covers, one of them usually defining an oil reservoir therewithin.

In some of these constructions, the head affixed to the cylinder block is provided externally to the contour of the shell portion of the compressor, being affixed to the cylinder block by means of screws (WO2005/026548) or by welding.

The systems for affixing the head to the cylinder block by means of screws can present, over time, undesirable leaks of the refrigerant fluid in the form of gas. Since the head, in these constructions, is external to the contour of the shell portion, the refrigerant gas leaks to the environment in which the compressor is installed, resulting in volume loss of said gas in the refrigeration system.

Besides the possibility of gas leak, the known compressor constructions in which the head is external to the shell contour present an undesirable noise level. The construction in which the head is externally provided has the advantage of allowing a better dissipation of the heat generated by the gas compression in the discharge operation of the compressor. However, such known constructions still allow the heating of the internal parts of the compressor, due to the heat that is transferred from the head to the compressor parts provided adjacent to said head.

SUMMARY OF THE INVENTION

It is an object of the present invention to provide a constructive arrangement for a hermetic refrigeration compressor presenting a head external to the shell contour, which prevents the refrigerant fluid from leaking to the exterior of the compressor shell, improves heat dissipation in the head region and presents a simple and low cost construction. It is another object of the present invention to provide an arrangement as cited above, which improves the noise attenuation in the compressors presenting the head external to the contour of the shell portion.

These and other objects of the present invention are attained through the provision of a constructive arrangement for a hermetic refrigeration compressor of the type which comprises: a hermetic shell; a cylinder block defining, in a single piece, a shell portion and a compression cylinder having an end which is opened to the exterior of the hermetic shell; a valve plate closing said end of the compression cylinder; a head affixed to the cylinder block over the valve plate, so as to define a discharge chamber with the latter, the cylinder block incorporating a tubular projection external to the shell and peripherally surrounding the valve plate and at least part of the head, said arrangement further comprising an outer cover hermetically affixed to the tubular projection, so as to define, with the latter, a discharge plenum maintained in fluid communication with the discharge chamber, one of the parts defined by the tubular projection and by said outer cover being provided with a refrigerant gas outlet opened to the exterior of the hermetic shell.

The present invention solves, economically and reliably, the problem of the compressor working fluid leaking through the interfaces of the components exposed to the environment external to the head, in the constructions in which the latter is provided external to the contour of the compressor shell, said leaks occurring in the joint between the head and shell made by means of screws only, such as, for example, in WO 05026548A1. Such leaks, when they occur, cause a continuous degradation in the compressor efficiency.

The constructive arrangement of the compressor of the present invention further allows obtaining an additional discharge chamber which facilitates heat exchange, through the head wall, between the relatively hot gas of the discharge chamber and the external environment, forming a volume of air which actuates dissipating the heat coming from the discharge chamber.

According to another aspect of the present invention, the head presents a first discharge chamber and a second discharge chamber in fluid communication through a passage dimensioned in such a way as to attenuate both the noise and the pulsation of the discharge gas, which is desirable in compressors using refrigerant gas CO2 for commercial refrigeration. The present construction further allows increasing the heat exchange between the relatively hot discharge gas and the external environment, reducing overheating of the internal components of the compressor (which improves its reliability), as well as of the gas being drawn (which improves its efficiency).

BRIEF DESCRIPTION OF THE DRAWINGS

The invention will be described below, based on the appended drawings, given by way of example of an embodiment of the invention and in which.

DESCRIPTION OF THE ILLUSTRATED EMBODIMENT

Figure 1:
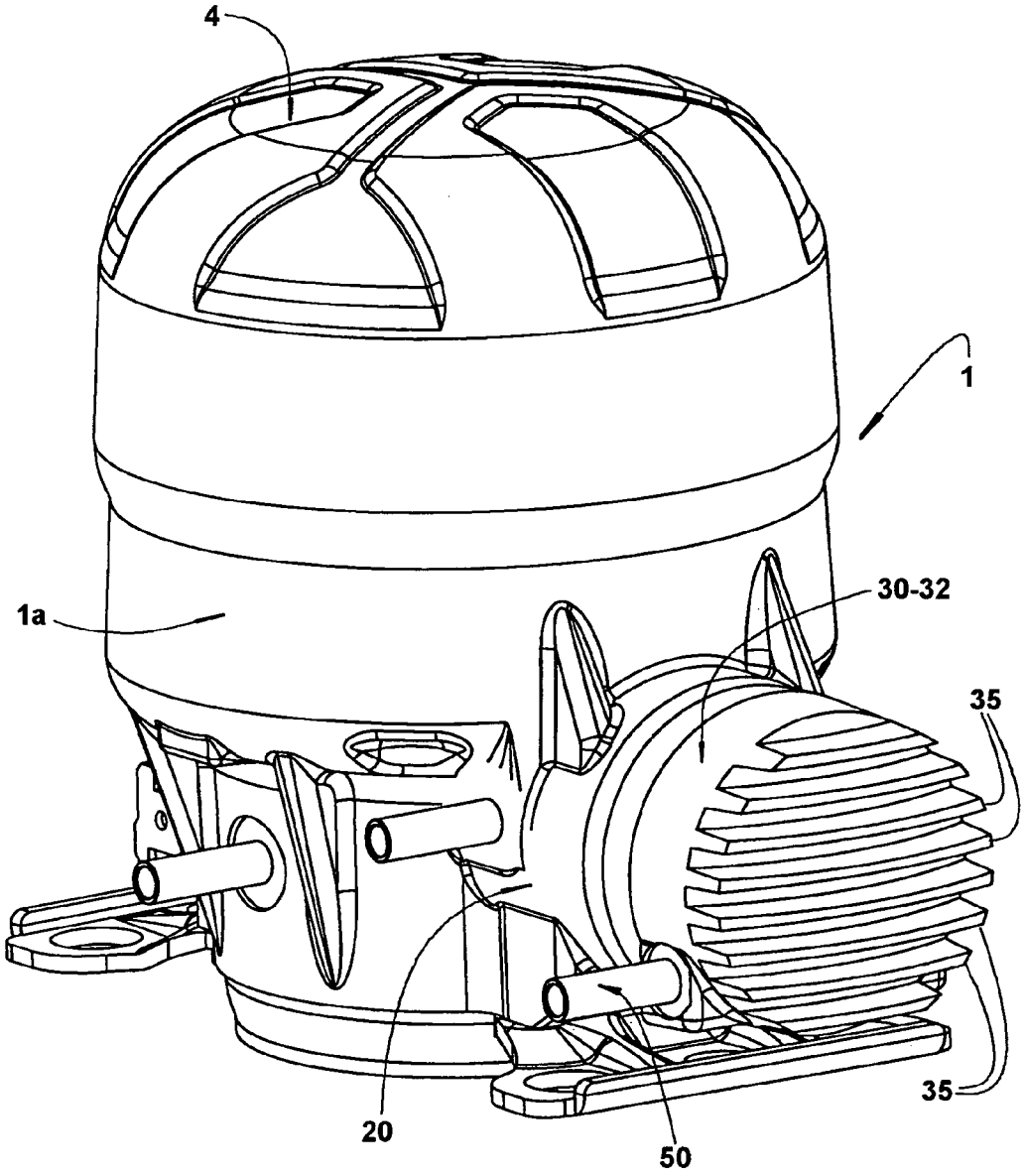
FIG. 1 schematically represents a perspective view of a hermetic refrigeration compressor to which the present solution is applied.
Figure 2:
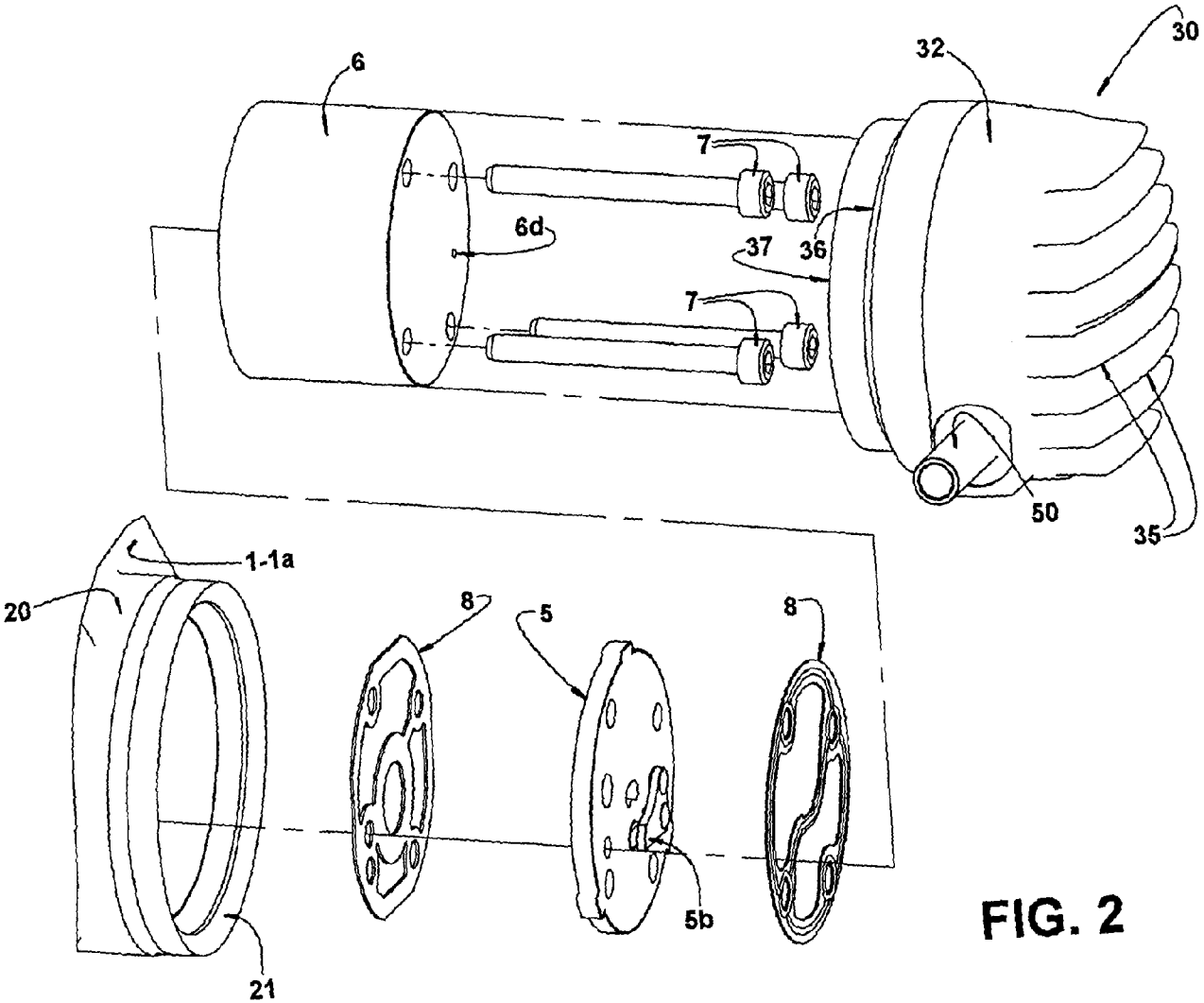
FIG. 2 schematically represents an exploded perspective view of the head and of the outer cover of the present solution, which are illustrated in FIG. 1 in a mounted condition.
Figure 3:
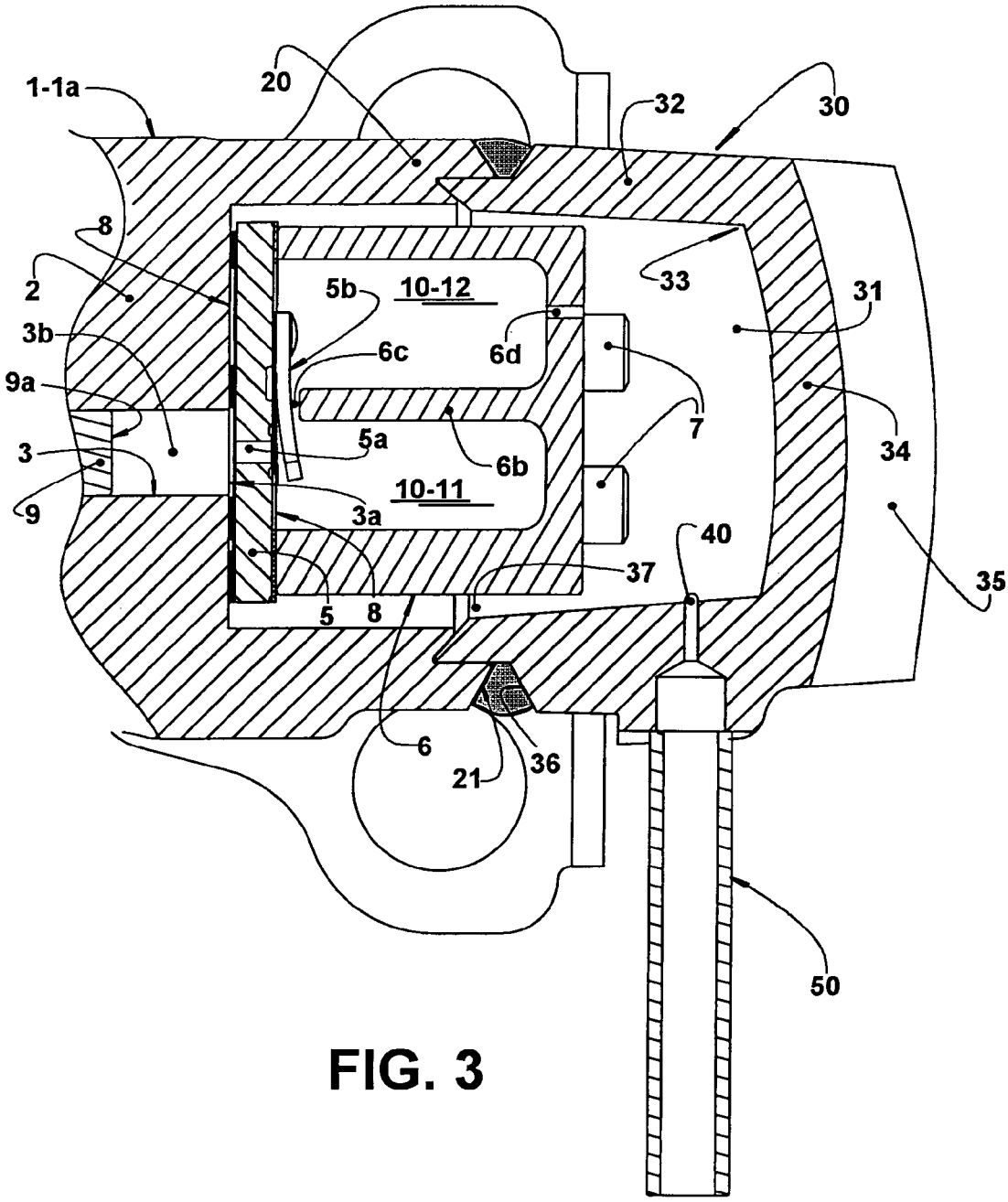
FIG. 3 schematically represents a longitudinal sectional view of the head and of the outer cover affixed thereto, in which the head presents two discharge chambers.

The present invention will be described for a hermetic refrigeration compressor of the type which comprises a hermetic shell 1 and a motor-compressor assembly, which includes a cylinder block 2 defining, in a single piece, a shell portion 1*a* of the hermetic shell 1 and a compression cylinder 3.

The shell portion 1*a* receives and secures at least one cover 4 which, when positioned inferiorly to the shell portion 1*a*, generally internally defines an oil reservoir (not illustrated) in the constructions in which the compressor needs lubricant oil to lubricate the relatively moving parts. The shell portion 1*a* and the cover 4, when affixed to each other, define the hermetic shell 1.

The compression cylinder 3 presents an end 3*a* opened to the exterior of the hermetic shell 1 and closed by a valve plate 5 provided with a suction orifice (not illustrated) and a discharge orifice 5*a*, which are respectively and selectively closed by a suction valve (not illustrated) and a discharge valve 5*b*. The cylinder block 2 secures, over the valve plate 5, a head 6, in order to define, with the latter, at least one discharge chamber 10, as described ahead. In the illustrated construction, the head 6 is secured directly to the valve plate 5 mounted to the cylinder block 2 through screws 7, said assembly further including conventional sealing gaskets 8. However, it should be understood that the mounting of the head 6 to the cylinder block 2 can also be carried out by mounting said head 6 peripherally surrounding the valve plate 5 and being directly affixed to the cylinder block 2.

The compression cylinder 3 defines, between the valve plate 5 and a top portion 9*a* of a reciprocating piston 9 housed in the interior of the compression cylinder 3, a compression chamber 3*b*, in a selective fluid communication with at least one discharge chamber 10 of the head 6, upon movement of the discharge valve 5*b* mounted to the valve plate 5.

According to the present invention, the cylinder block 2 incorporates a tubular projection 20 external to the hermetic shell 1 and which peripherally surrounds the valve plate 5 and at least part of the head 6, said arrangement further comprising an end outer cover 30, which is hermetically affixed, for example, by welding, to the tubular projection 20, so as to define, with the latter, a discharge plenum 31 maintained in fluid communication with one of the discharge chambers 10, one of the parts defined by the tubular projection 20 and by said outer cover 30 being provided with a refrigerant gas outlet 40 opened to the exterior of the hermetic shell 1. In the illustrated construction, the refrigerant gas outlet 40 is, for example, radially provided in the outer cover 30, securing the end of a discharge pipe 50 external to the hermetic shell 1. Although not illustrated, it should be understood that said refrigerant gas outlet 40 can be provided through the tubular projection 20, without prejudice to the inventive concept presented herein.

In a way of carrying out the present invention, the cylinder block 2 incorporates, in a single piece, the tubular projection 20, which radially extends from the shell portion 1*a*. In a constructive variation, the tubular projection 20 is welded to the shell portion 1*a* around the valve plate 5.

In the illustrated construction, the tubular projection 20 surrounds the head 6 and maintains therewith and throughout its peripheral contour, a radial spacing, for example constant and which defines part of the discharge plenum 31.

It should be understood that, although the tubular projection 30 surrounds the whole peripheral contour of the head 6, other constructions (not illustrated) are possible, such as the provision of a tubular projection surrounding only the portion of the head 6 inside which the discharge chamber(s) 10 is (are) defined.

In the illustrated construction, the head 6 defines, with the valve plate 5: a first discharge chamber 11, in direct fluid communication with the discharge orifice 5*a*; and a second discharge chamber 12, in sequential fluid communication with said first discharge chamber 11 and with the discharge plenum 31 of the outer cover 30, through which it maintains fluid communication with the refrigerant gas outlet 40 and, through the latter, with the discharge pipe 50.

In the illustrated solution, the first discharge chamber 11 is maintained in fluid communication with the second discharge chamber 12 through a passage 6*c* provided in a common dividing wall 6*b*, which is attached to the head 6, for example, being incorporated in a single piece therewith during its formation. The passage 6*c* is defined with an adjacent face of the valve plate 5, in which the discharge valve 5*b* is affixed.

In another way of carrying out the present invention, not illustrated, the head 6 defines, with the valve plate 5, a single discharge chamber 10 which maintains fluid communication with the discharge orifice 5*a* and with the refrigerant gas outlet 40.

The fluid communication of the second discharge chamber with the discharge plenum 31 occurs through an orifice 6*d* provided in the head 6, axially spaced from the passage 6*c*, said spacing being calculated so as to result in a determined degree of noise attenuation of the gas being conducted to the discharge plenum 31. According to the present invention, the discharge plenum 31 is dimensioned to operate as a noise muffling chamber, during the discharge of compressed gas from the compression chamber 3*b*.

As illustrated, the outer cover 30 comprises a tubular body 32 closed, at one end 33, by a front wall 34 which externally incorporates, in a single piece, a plurality of heat dissipation fins 35. It should be understood that, although the illustrated construction externally presents the whole front wall 34 provided with heat dissipation fins 35, other constructions within the concept of providing fins for dissipating heat are possible, such as the provision of said fins on part of the front wall 34 and also the provision of fins externally defined on the peripheral side surface of the tubular body 32 of the outer cover 30.

Although not illustrated, the outer cover 30 can be internally provided with noise absorbing means, such as a lining in a noise absorbing material and/or also provided with resonators appropriate for the frequency band to be attenuated.

According to the present invention and as illustrated, the tubular projection 20 presents a free end edge 21, against which is seated and affixed a peripheral edge 36 of an open opposite end 37 of the outer cover 30. In a way of carrying out the present invention, when the parts of tubular projection 20 and outer cover 30 are made of metallic material, the peripheral edge 36 of the outer cover 30 is affixed, by welding, to the free end edge 21 of the tubular projection 20. This welding can be obtained by conventional means.

It should be understood that, according to the present invention, the fixation of the outer cover 30 in the tubular projection 20 can occur away from the seating region of the free end edge 21 and peripheral edge 36 of the outer cover 30, for example close to a side wall of the tubular projection 20.

The supply of refrigerant gas to the compression cylinder 3*b* has not been illustrated and described herein, as it does not form part of the concept of the constructive discharge arrangement object of the present invention. However, it should be understood that the suction arrangement can be made through parts of the assembly not including the outer cover 30, the tubular projection 20 and the head 6 which are considered in the present discharge arrangement.

The new constructive arrangement allows obtaining a discharge chamber which facilitates the direct heat exchange, through the head cover wall, of the relatively hot gas in the discharge chamber with the external environment. The incorporation of a first discharge chamber 11 in the head 6 and the passage through a small orifice towards a second discharge chamber 12, formed in the interior of the head 6, permits attenuating the noise and pulsation, which is desirable in compressors operating with carbon-based refrigerant gas, particularly CO2, used for commercial refrigeration. At the same time, this construction allows increasing the heat exchange of the relatively hot discharge gas with the external environment, reducing the overheating of the internal components of the compressor, improving the reliability thereof.

The provision of the outer cover 30 economically and reliably solves the problem of the refrigerant fluid leaking through the interfaces of the components exposed to the environment external to the hermetic shell 1, particularly through the interface between the head 6 and the cylinder block 2.

While only one embodiment of the present invention has been illustrated herein, it should be understood that alterations can be made in the form and physical arrangement of the constitutive elements, without departing from the constructive concept defined in the claims that accompany the present specification.

The invention claimed is:

1. A constructive arrangement for a hermetic refrigeration compressor of the type which comprises: a hermetic shell; a cylinder block defining, in a single piece, a shell portion and a compression cylinder having an end, which is opened to the exterior of the hermetic shell; a valve plate closing said end of the compression cylinder; a head affixed to the cylinder block over the valve plate, so as to define, with the latter, at least one discharge chamber, characterized in that the cylinder block incorporates, in a single piece, a tubular projection which radially extends from the shell portion, external to the hermetic shell and peripherally surrounding the valve plate and at least part of the head, said arrangement further comprising an outer cover hermetically affixed to the tubular projection, so as to define, with the latter, a discharge plenum maintained in fluid communication with the discharge chamber, one of the parts defined by the tubular projection and by said outer cover being provided with a refrigerant gas outlet opened to the exterior of the hermetic shell, the tubular projection presenting a free end edge and the outer cover comprising a tubular body closed, at one end by a front wall and having the peripheral edge of its open opposed end affixed to the free end edge of the tubular projection.

2. The constructive arrangement, as set forth in claim 1, characterized in that the discharge plenum is dimensioned so as to define a noise muffling chamber.

3. The constructive arrangement, as set forth in claim 1, characterized in that the outer cover is provided, at least on part of its external surface, with heat dissipation fins.

4. The constructive arrangement, as set forth in claim 1, characterized in that the refrigerant gas outlet is radially provided in the outer cover, securing the end of a discharge pipe external to the hermetic shell.

5. The constructive arrangement, as set forth in claim 1, characterized in that the fixation between the tubular projection and the outer cover is made by welding.

6. The constructive arrangement, as set forth in claim 1, characterized in that the front wall of the outer cover externally incorporates, in a single piece, a plurality of heat dissipation fins.

7. The constructive arrangement, as set forth in claim 1 and in which the valve plate is provided with a discharge orifice, characterized in that the head presents a first and a second discharge chamber, in sequential fluid communication, said first discharge chamber being in direct fluid communication with the discharge orifice and said second discharge chamber being in direct fluid communication with the discharge plenum of the outer cover.

8. The constructive arrangement, as set forth in claim 1, characterized in that the refrigerant gas outlet secures the end of a discharge pipe external to the hermetic shell.

* * * * *